US006968716B1

(12) United States Patent
Ling

(10) Patent No.: US 6,968,716 B1
(45) Date of Patent: Nov. 29, 2005

(54) CONNECTION LOCK EXECUTING LOCKING OPERATION WITHOUT KEYS

(75) Inventor: Renny Tse-Haw Ling, Chung-Ho (TW)

(73) Assignee: Sinox Co., Ltd., Chung-Ho (TW)

( * ) Notice: Subject to any disclaimer, the term of this patent is extended or adjusted under 35 U.S.C. 154(b) by 0 days.

(21) Appl. No.: 10/929,387

(22) Filed: Aug. 31, 2004

(51) Int. Cl.[7] ..... E05B 73/00
(52) U.S. Cl. ..... 70/14; 70/58; 70/492
(58) Field of Search ..... 70/14, 18, 49, 70/57, 58, 423, 424, 427–430, 492; 248/551–553

(56) References Cited

U.S. PATENT DOCUMENTS 1,689,875 A * 10/1928 Jacobi ..... 70/216
6,058,744 A * 5/2000 Ling ..... 70/28
6,321,579 B1 * 11/2001 Reyes ..... 70/58
6,449,992 B1 * 9/2002 Yu et al. ..... 70/58
6,536,244 B1 * 3/2003 Chang ..... 70/58
6,619,081 B1 * 9/2003 Yu ..... 70/58
6,880,373 B2 * 4/2005 Ling ..... 70/58
2003/0106349 A1 * 6/2003 Broadbridge et al. ..... 70/58

* cited by examiner

*Primary Examiner*—Lloyd A. Gall
(74) *Attorney, Agent, or Firm*—Alan D. Kamrath; Nikolai & Mersereau, P.A.

(57) ABSTRACT

A connection lock capable of executing locking operation without keys includes a case to house an actuation mechanism, a rotary cylinder and an elastic element. The actuation mechanism includes a movable leg and a fixed leg. The movable leg is moved by the elastic element to be close to the fixed leg at an unlocking position in normal conditions. The rotary cylinder has a nudging member extended from the front end that can move the movable leg away from the fixed leg at a locking position. The case has a one-way hump corresponding to the rotary cylinder to allow the rotary cylinder to be turned in one way to switch the movable leg from the unlocking position close to the fixed leg and to the extended and locking position.

10 Claims, 4 Drawing Sheets

CONNECTION LOCK EXECUTING LOCKING OPERATION WITHOUT KEYS

FIELD OF THE INVENTION

The present invention relates to a connection lock capable of executing locking operation without keys adopted for use to couple a portable first article and chain to a second article through a connection element to lock the first article and particularly for use on a portable article that has an insertion hole to receive coupling.

BACKGROUND OF THE INVENTION

To prevent portable articles such as notebook computers from being stolen, there are many theft-deterrent locks being developed and introduced on the market. The most commonly used lock includes a lock head connecting to a steel cable. The lock head may be latched on the computer case, while the steel cable may be chained to a stationary object such as a table leg or a post.

Many references can be found in the prior art regard the techniques of the computer lock. For instance, R.O.C. patent publication No. 434556 entitled "Lock for computer equipment" discloses a lock structure that targets the insertion hole of the computer case. It adopts a design that can achieve the locking condition from the unlocking condition without using keys. FIGS. 5 and 6 of that patent show that the lock includes a case, a core, a face plate, a coupling ring, a latch bolt and a pin. The latch bolt bridges two clamping members at the front end of the core and is integrated with the core. The pin runs through the core and is turnable in a co-axial manner therewith, and may be moved by the case to change the relative position of the pin and the latch bolt, thereby to form different angular alterations of the front ends of the pin and latch bolt and result in "--shaped" and "cross-shaped" combinations to be inserted into or removed from the insertion hole, and may form a locking condition once inserted into the insertion hole.

In the cited reference the relative angular positions of the latch bolt and the pin may be changed through the movements of the core and case. However the rotation center must be on the same axis. To prevent the interference during relative movements, the latch bolt has to be carved to form a hollow interior to couple with the pin in a staggered manner. Hence to avoid the interference between the latch bolt and the pin during operation, a complicated shape has to be adopted. As a result, fabrication and assembly are difficult and tedious.

Moreover, the latch bolt is clamped by two fingers extended from the front end of the core and moved with the core in an integrated manner. If the interval between the two fingers were not adequate, coupling of the latch bolt and the core is difficult or impossible. On the other hand, if the coupling allowance were too large, a gap will be formed to result in a undesirable moving relationship between the core and the latch bolt. All of this could make locking and unlocking operations unreliable. Hence there is still room for improvement for the cited reference in terms of structural design and operation.

SUMMARY OF THE INVENTION

Therefore the primary object of the invention is to provide a connection lock that has a simpler structure and reliable operation, and is easier to assemble.

The connection lock according to the invention includes a case and an actuation mechanism, an elastic element, a rotary cylinder and a nudging member located on the rotary cylinder that is housed in the case. The actuation mechanism includes a movable leg and fixed leg. The movable leg is pushed by the elastic element to be close to the fixed leg at an unlocking position in normal conditions. The nudging member may be driven by the rotary cylinder to alter the angular relationship with the case and to move the movable leg away from the fixed leg to form a locking condition.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
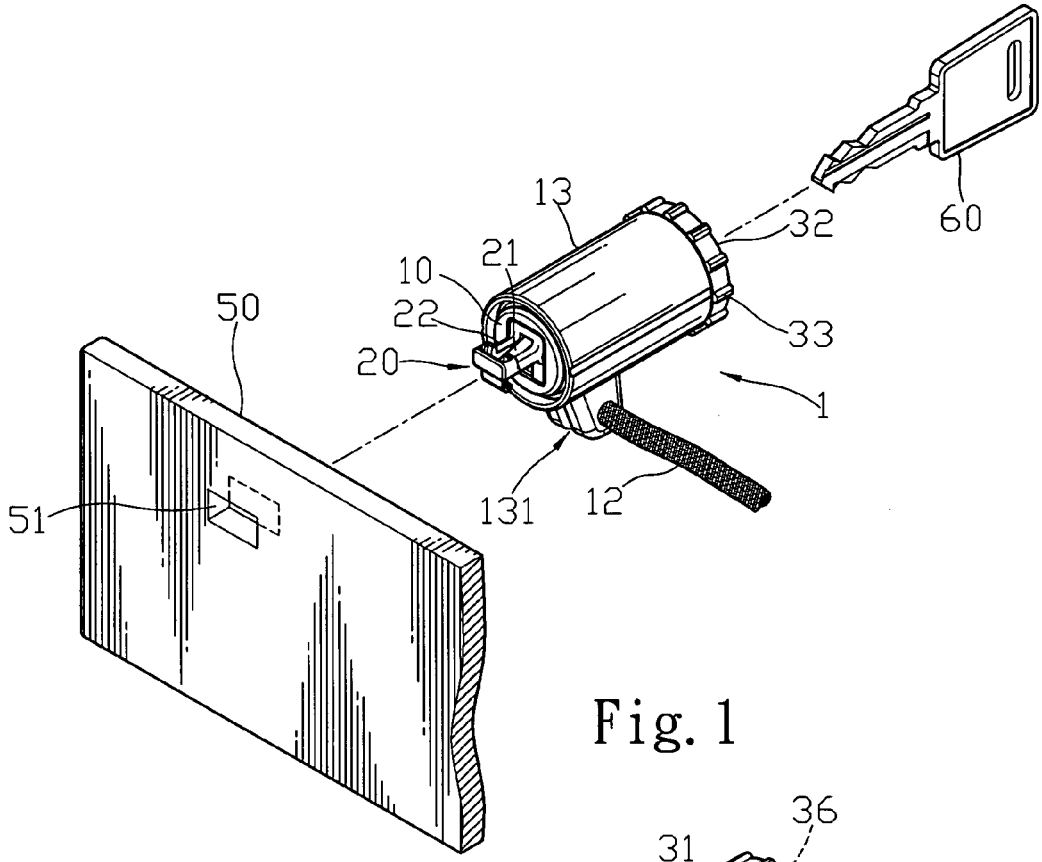
FIG. 1 is a perspective view of an embodiment of the invention.
Figure 2:
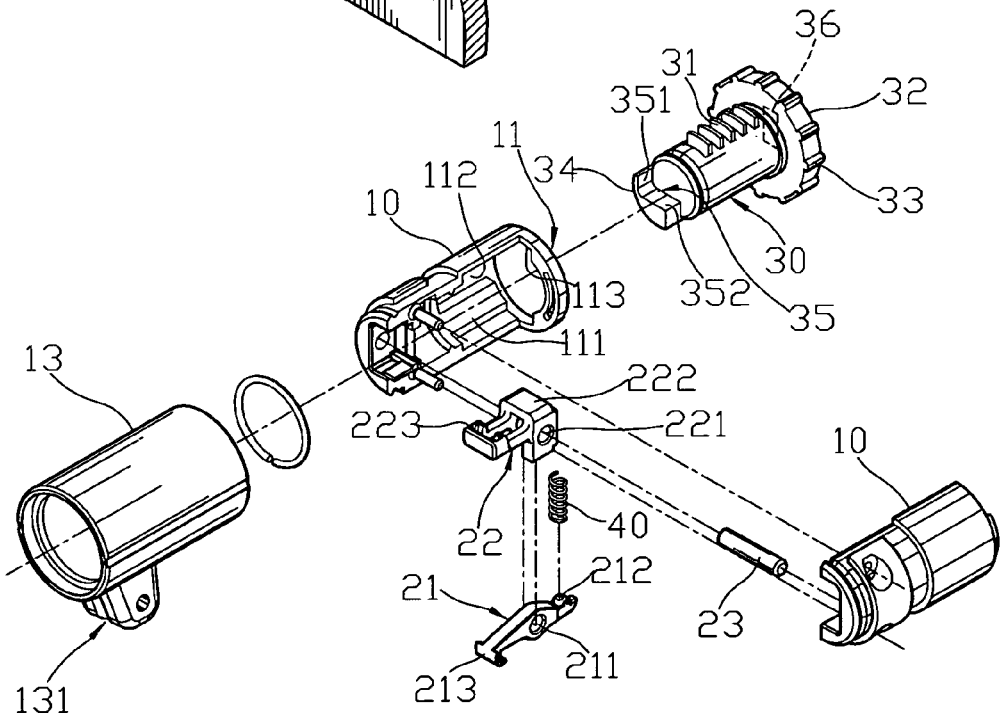
FIG. 2 is an exploded view of the invention.

Refer to FIGS. 1 and 2 for an embodiment of the invention. The connection lock includes a case 10 for housing an actuation mechanism 20, a rotary cylinder 30 and an elastic element 40. The lock thus formed may be used to lock a first article 50 (a portable product such as a notebook computer that has an insertion hole 51). The case 10 is a hollow barrel that has a housing chamber 11. The housing chamber 11 has a front end for housing the actuation mechanism 20 and a rear end forming a round opening 111 to accommodate the rotary cylinder 30. The wall adjacent to the round opening 111 has a first wedge trough 112 and a second wedge trough 113 formed thereon. The first wedge trough 112 and the second wedge trough 113 are bridged by a one-way hump 114 (referring to FIG. 4A). When in use, the case 10 may be fastened to connection element 12 such as a steel cable, chain and the like to chain to a second article (not shown in the drawings) such as a table leg or a post. Of course, the periphery of the case 10 may also be coupled with a sleeve 13 that has a lug 131 to connect to the connection element 12.

Figure 3:
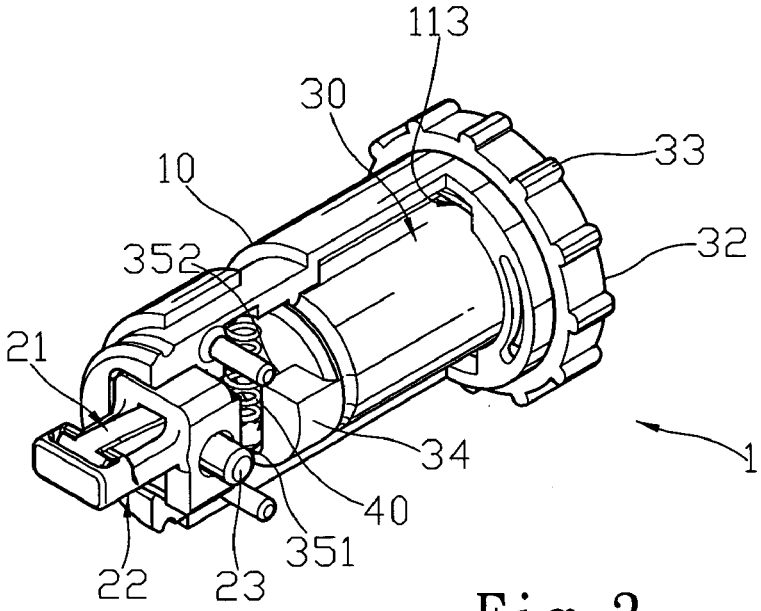
FIG. 3 is a schematic view of the invention with the case removed, showing the moveable leg close to the fixed leg.

The actuation mechanism 20 includes a movable leg 21 and a fixed leg 22 that have respectively a first aperture 211 and a second aperture 221 in the vertical direction to couple with a fastening bolt 23 for fastening to the case 10. One end thereof is extended outside the case 10. The fixed leg 22 has a portion located in the case 10 to form a head 222 that is substantially rectangular encased by the case 10 to become an integrated body. The movable leg 21 is extended to two ends from the first aperture 211. One end is extended outside the case 10 and other end is extended into the case 10 to form a bulged tip 212 to couple with one end of the elastic element 40. Hence the movable leg 21 is compressed by the elastic element 40 and turnable about the fastening bolt 23 to be close to the fixed leg 22 as shown in FIG. 3. It is to be noted that the elastic element 40 may be a spring as shown in the drawings, or other types of spring or sponges capable of providing the same function.

The rotary cylinder 30 is a cylindrical barrel housed in the round opening 111 of the case 10. It has one or more bucking members 31 on the outer side corresponding to and engageable with the first wedge trough 112 or the second wedge trough 113 to enable the rotary cylinder 30 and the case 10 to form a latched relationship without moving. In addition, the rotary cylinder 30 has a rear end extended to form a grasp section 32 to receive an external force to turn the rotary cylinder 30 and to change the relative position of the rotary cylinder 30 and the case 10. The grasp section 32 may have slip-resistant teeth 33 formed on the perimeter to increase the friction to facilitate grasping, or be covered by a slip-resistant ring.

The rotary cylinder 30 further has a nudging member 34 at the front end extending outwards axially, and is movable therewith. The nudging member 34 has a nudging surface 35 which may be a helical surface, an arched surface, a sloped surface or a parabolic surface on which every point is more and more closely to the rotational center of the rotary cylinder 30, or as shown in the drawings, includes a holding section 351 and a raising section 352 that are connected to each other and spaced from the rotational center at different distances. It is mainly to generate a nudge action on the movable leg 21 and to alter the relative position between the movable leg 21 and the fixed leg 22. The movement relationship will be discussed later.

Figure 4A:
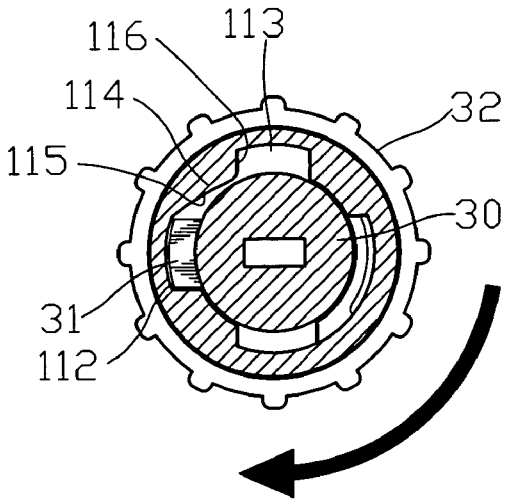
FIGS. 4A and 4B are schematic views of the invention with the rotary cylinder and the case switched to different angular positions.
Figure 4B:
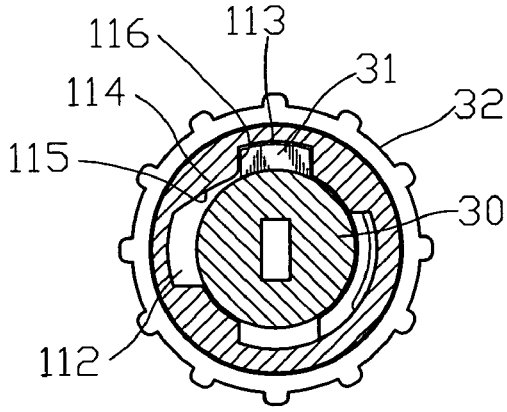

By means of the construction set forth above, the connection lock 1 according to the invention may be unlocked or locked through a key 60 inserting into a key way 36. However, when the rotary cylinder 30 and the case 10 are in a condition in which the bucking member 31 drops into the first wedge trough 112, as the first wedge trough 112 and the second wedge trough 113 are bridged by the one-way hump 114, when the rotary cylinder 30 is driven because of the grasp section 32 is subject to an external force, and the bucking member 31 is moved towards the second wedge trough 113 as shown in FIGS. 4A and 4B, and the bucking member 31 will be retracted gradually into the rotary cylinder 30 along a chamfered surface 115 of the arched or sloped surface and pass over the one-way hump 30 to reach a position corresponding to the second wedge trough 113, then drop into the second wedge trough 113 and be confined by a vertical stopping surface 116. Therefore the rotary cylinder 30 can no longer receive forces directly and return to the first wedge trough 112. Hence the rotary cylinder 30 maintains a non-moving relationship with the case 10.

Figure 5:
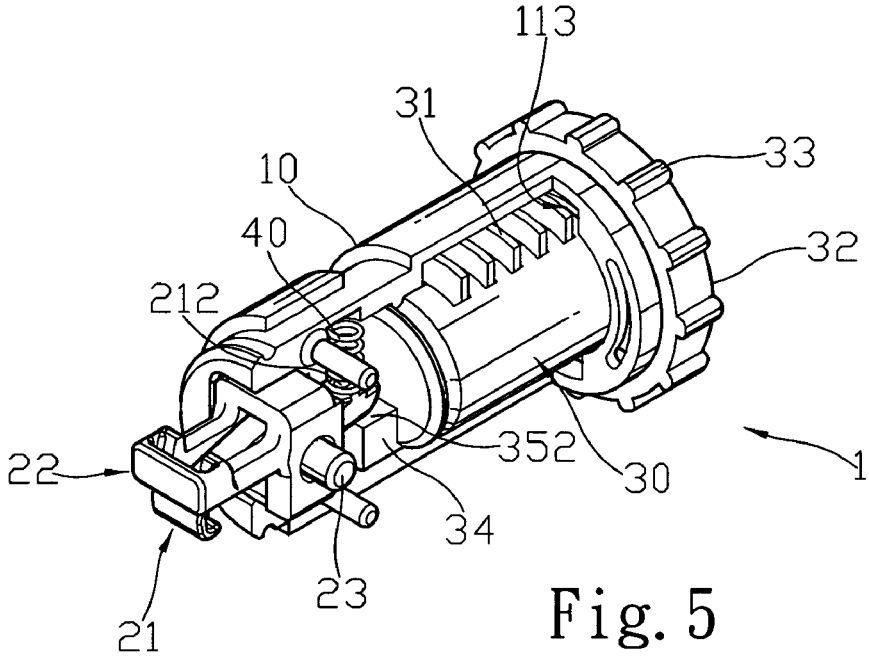
FIG. 5 is a schematic view of the invention with the case removed, showing the moveable leg moved away from the fixed leg.

During the bucking member 31 is driven by the rotary cylinder 30 and moved from the first wedge trough 112 to the second wedge trough 113, the nudging member 34 also is driven. The holding section 351 of the nudging surface 35 is moved to the bottom of the movable leg 21 and holds the movable leg 21. When the rotation continues, the nudging surface under the bottom of the movable leg 21 shifts to the raising section 352 to tilt the movable leg 21 outwards relative to the fixed leg 22 to reach the locking position as shown in FIG. 5.

Figure 6A:
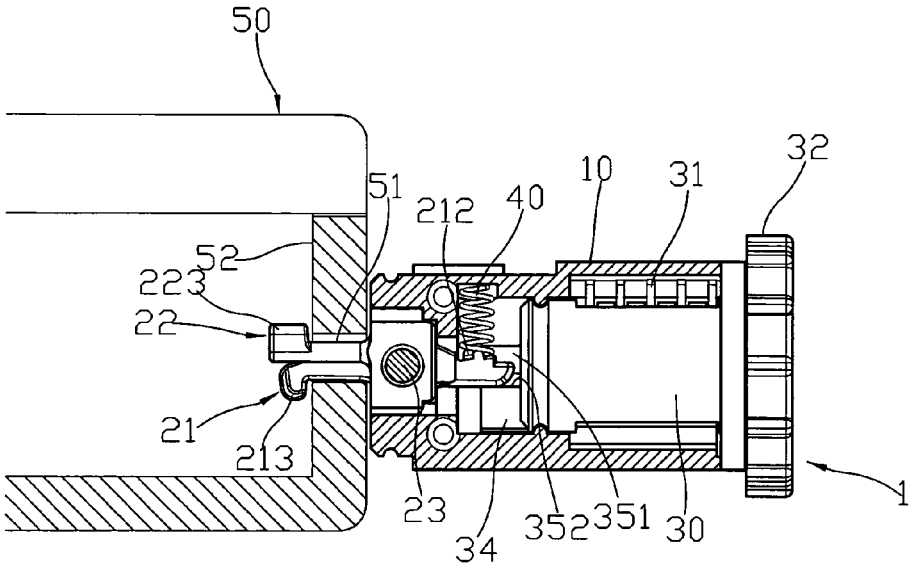
FIGS. 6A and 6B are schematic views of the invention chained to a first article.
Figure 6B:
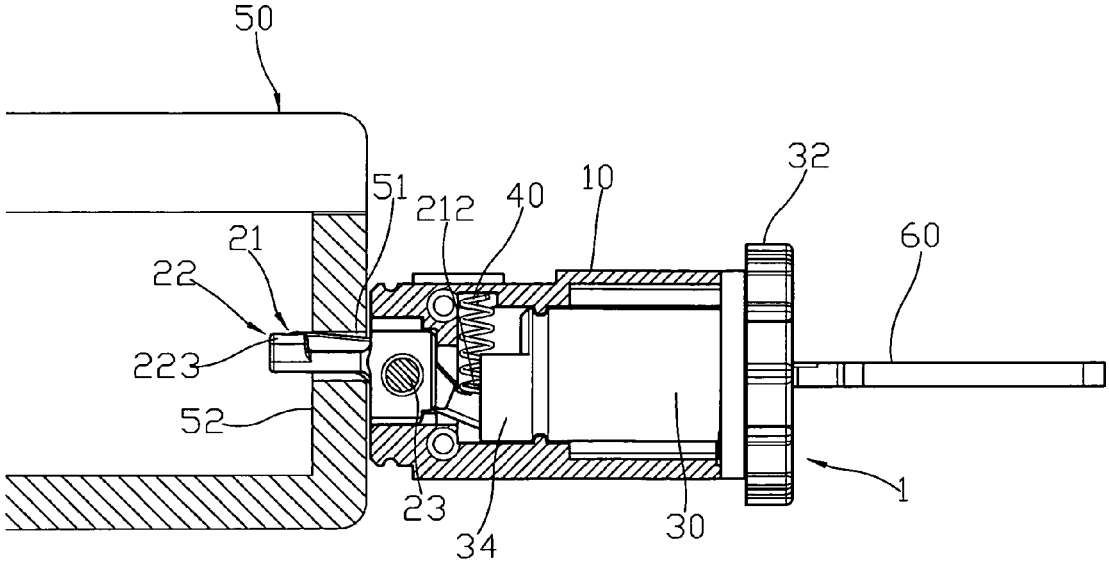

Hence the actuation mechanism 20 can switch the movable leg 21 and the fixed leg 22 between a coupling position and a bifurcating position to enable the connection lock 1 to be coupled with the first article 50 through the insertion hole 51. Referring to FIGS. 6A and 6B, when the movable leg 21 and the fixed leg 22 are moved close to each other, they may be inserted into the matching insertion hole 51 formed on a wall of the first article 50 to make the case 10 in contact with the outer side of the wall. Then the movable leg 21 may be actuated to tilt outwards relative to the fixed leg 22 so that flanges 213 and 223 formed on the distal ends of the two legs latch on the inner wall surface 52 around the insertion hole 51 and cannot be moved out. Thereby the connection lock 1 and the first article 50 form an inseparable condition. Thus the first article 50 may be locked to the second article through the connection element 12.

Figure 7:
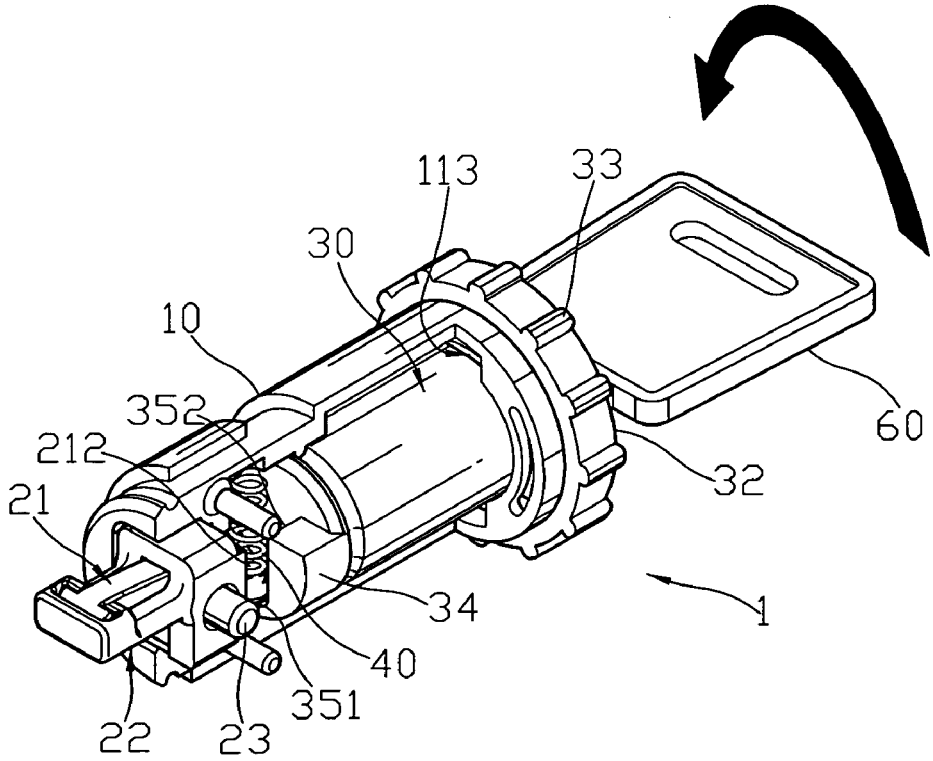
FIG. 7 is a schematic view of the invention with the case removed, showing the rotary cylinder is turned relative to the case by a key.

Based on previously discussion, it is clear that the operation of switching the two legs of the actuation mechanism 20 from the coupling condition to the bifurcating condition may be accomplished without using the key 60. This is mainly due to the one-way hump 114 located in the case 10. Hence it achieves the objective of the invention of executing locking operation without keys. However, reverse operation has to rely the key 60. Referring to FIG. 7, after the key 60 is inserted into the key way 36 from the rear end of the rotary cylinder 30, through the serrations of the key, the bucking member 31 may be retracted into the rotary cylinder 30 so that by turning the rotary cylinder 30, the bucking member 31 may be moved to a position corresponding to the first wedge trough 112, and the movable leg 21 may be returned to the coupled and unlocking position relative to the fixed leg 22.

In summary, in the present invention various elements in the lock do not have to be aligned on the same rotational axis. The structure is simpler, and operation is more reliable, and assembly also is easier.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments that do not depart from the spirit and scope of the invention.

What is claimed is:

1. A connection lock executing locking operation without keys for coupling to a first article which has an insertion hole, comprising:

an actuation mechanism including a movable leg and a fixed leg that are movable close to each other to insert into the insertion hole and movable away from each other to latch the first article;

a case for housing the actuation mechanism having a housing chamber which has a round opening, a first wedge trough and a second wedge trough formed on a wall around the round opening, and a one-way hump bridging the first and the second wedge troughs, the one-way hump having a chamfered surface;

an elastic element located in the case for providing an elastic action force on the movable leg to be close to the fixed leg at a unlocking position in normal conditions;

a rotary cylinder located in the round opening and extended outside the case to form a grasp section having at least one bucking member on the periphery thereof wedging in the first wedge trough such that when the rotary cylinder is subject to a force and turns the bucking member is retracted along the chamfered surface to pass over the one-way hump and to be wedged in the second wedge trough; and a nudging member located on the rotary cylinder and driven by the rotary cylinder to move the movable leg away from the fixed leg at a locking position when the bucking member is moved from the first wedge trough to the second wedge trough.

2. The connection lock of claim 1, wherein the movable leg and the fixed leg have respectively a flange formed on a distal end thereof such that when the movable leg and the fixed leg have been moved close to each other and inserted into the insertion hole, and are moved away from each other thereafter, the flanges latch on an inner wall around the insertion hole.

3. The connection lock of claim 1, wherein the grasp section has a plurality of slip-resistant teeth on the perimeter thereof.

4. The connection lock of claim 1, wherein the rotary cylinder has a key way to receive a key which has serrations to retract the bucking member into the rotary cylinder.

5. The connection lock of claim 1, wherein the nudging member is extended axially from the grasp section and has a nudging surface that includes a holding section and a raising section.

6. The connection lock of claim 1, wherein the nudging member is extended axially from the grasp section and has a nudging surface.

7. A connection lock of claim 1, wherein the nudging surface of the nudging member is continued more and more closely to the rotational center of the grasp section.

8. The connection lock of claim 1, wherein the elastic element is a spring that has one end coupled on the case and other end coupled on the movable leg.

9. The connection lock of claim 1, wherein the case is fastened to a connection element.

10. The connection lock of claim 1, wherein the case is coupled with a sleeve on the periphery, the sleeve having a lug to fasten to a connection element.

* * * * *